US012291961B2

(12) United States Patent
Salem et al.

(10) Patent No.: US 12,291,961 B2
(45) Date of Patent: May 6, 2025

(54) IN-SITU BOTTOMHOLE ASSEMBLY ANALYSIS SYSTEMS AND METHODS TO PERFORM AN IN-SITU ANALYSIS OF A DOWNHOLE COMMUNICATION SYSTEM

(71) Applicant: Halliburton Energy Services, Inc., Houston, TX (US)

(72) Inventors: Jebreel M M Salem, Houston, TX (US); Matthew C. Griffing, Houston, TX (US); Imran Sharif Vehra, Houston, TX (US); Ranganathan Sridharan, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 269 days.

(21) Appl. No.: 17/725,520

(22) Filed: Apr. 20, 2022

(65) Prior Publication Data

US 2023/0340872 A1 Oct. 26, 2023

(51) Int. Cl.
*E21B 47/12* (2012.01)
*E21B 47/13* (2012.01)

(52) U.S. Cl.
CPC ..... *E21B 47/13* (2020.05)

(58) Field of Classification Search
None
See application file for complete search history.

(56) References Cited

U.S. PATENT DOCUMENTS 6,108,605 A * 8/2000 Doyle ..... G01V 3/28 702/7
2011/0304474 A1 12/2011 Salamitou et al.
2014/0015530 A1 1/2014 Miles et al.
2016/0201455 A1* 7/2016 Liu ..... H04W 52/0245 340/854.6
2016/0290847 A1 10/2016 Gronsberg et al.
2018/0136355 A1 5/2018 Zhang et al.
2018/0348394 A1* 12/2018 Wilson ..... G01V 3/26
2018/0371901 A1 12/2018 Lakings et al.

OTHER PUBLICATIONS

International Search Report & Written Opinion in PCT/US2022/026466, mailed Jan. 20, 2023.

* cited by examiner

*Primary Examiner* — Curtis A Kuntz
*Assistant Examiner* — Jerold B Murphy
(74) *Attorney, Agent, or Firm* — DeLizio, Peacock, Lewin & Guerra LLP

(57) ABSTRACT

A method to perform an in-situ analysis of a downhole communication system includes generating a transmission waveform of a transmission signal, and amplifying the transmission waveform by a digital to analog converter and an amplifier that are configured to modify a property of the transmission waveform. After generating the transmission waveform, the method includes transmitting the transmission waveform to a tool of a communication system. The method further includes filtering a response waveform from the tool, the response waveform being a waveform of a signal transmitted by the tool in response to receiving the transmission waveform. The method further includes performing an in-situ analysis of the tool based on the response waveform.

19 Claims, 9 Drawing Sheets

IN-SITU BOTTOMHOLE ASSEMBLY ANALYSIS SYSTEMS AND METHODS TO PERFORM AN IN-SITU ANALYSIS OF A DOWNHOLE COMMUNICATION SYSTEM

BACKGROUND

The present disclosure relates generally to in-situ bottomhole assembly analysis systems and methods to perform an in-situ analysis of a downhole communication system.

Communication with downhole tools and sensors of a downhole communications system are sometimes established and maintained to determine wellbore conditions at or near the downhole tools and sensors, and to check on the health of the downhole tools and sensors. However, downhole communication signals are sometimes masked by noise, interference, and/or other types of undesirable signals and/or conditions or have low signal-to-noise ratios. Further, some downhole tools and sensors operate on different communication protocols that are incompatible with each other.

BRIEF DESCRIPTION OF THE DRAWINGS

Illustrative embodiments of the present disclosure are described in detail below with reference to the attached drawing figures, which are incorporated by reference herein, and wherein.

Figure 1:
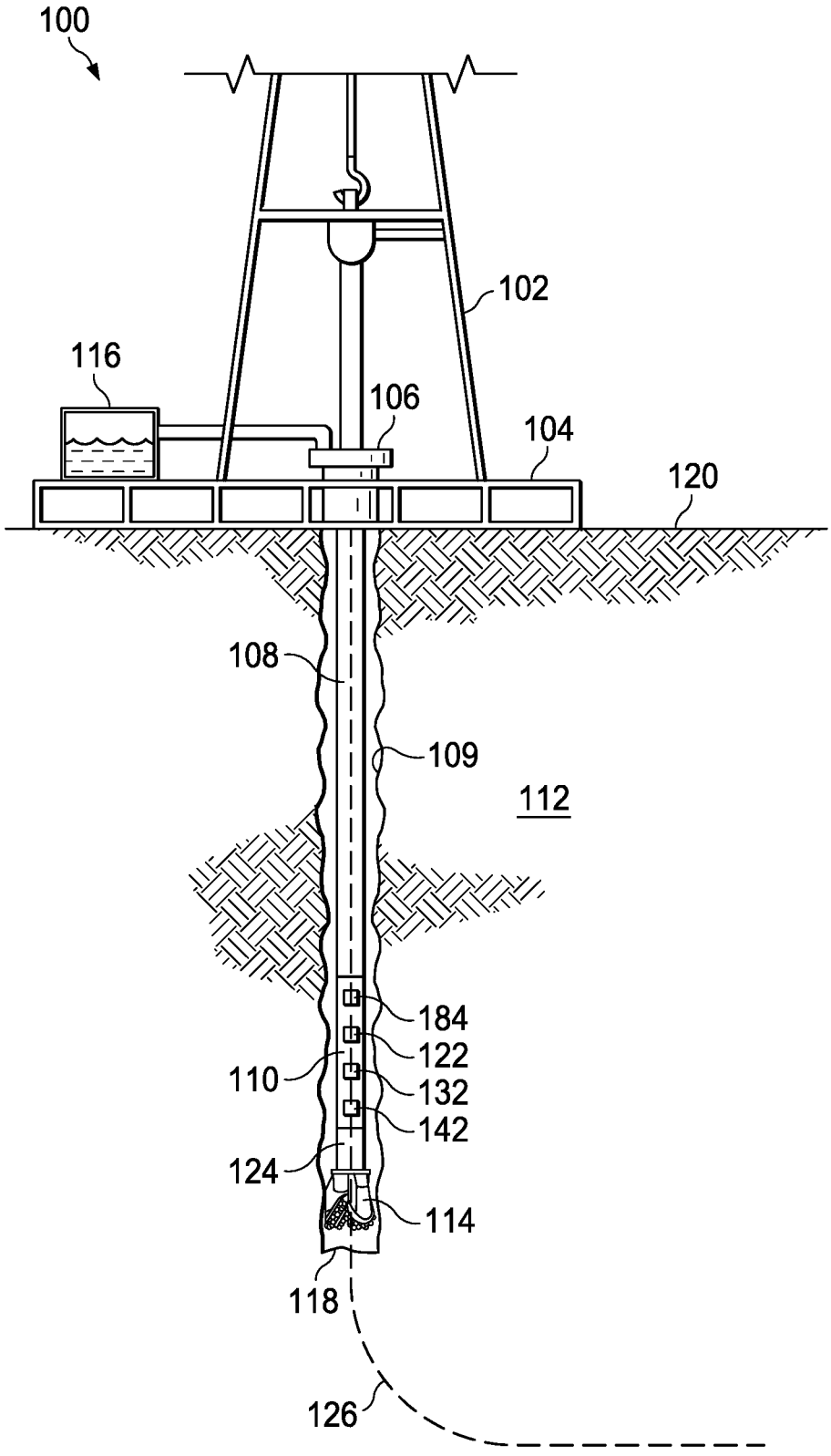
FIG. 1 is a schematic view of a drilling system within a well.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to in-situ bottomhole assembly analysis systems and methods to perform an in-situ analysis of a downhole communication system. As referred to herein, a downhole communication system refers to any system deployed downhole and having one or more tools or components that are configured to periodically or dynamically transmit and receive signals via one or more communication protocols. In some embodiments, the downhole communication system represents the communication system of a bottomhole assembly that is deployed downhole where tools, sensors, nodes, and other components of the bottomhole assembly periodically or dynamically receive signals from a controller (hereafter referred to as "controller") of the bottomhole assembly, and periodically or dynamically transmit signals to the controller. Further, tools, sensors, nodes, and other components of the bottomhole assembly that are configured to transmit and/or receive signals from the controller are collectively referred to as workers, or each referred to as a worker. In some embodiments, a subbus provides communication, power, and signal synchronization to one or more of the tools, sensors, nodes, and other components of the downhole communication system.

A modem of a downhole communication system (such as a modem of a controller or a modem of a worker) includes or is communicatively coupled to a digital-to-analog converter (DAC) and an amplifier (such as a linear power amplifier, a differential amplifier, or another type of amplifier) that are configured to control the waveform of transmission for waveforms transmitted from the modem, and to modify one or more properties of the transmission waveforms including, but not limited to, the frequency band, the shape, the phase, the amplitude, and other properties of the transmission waveforms, before the waveforms are transmitted to other tools and components of the downhole communication system. As referred to herein, a transmission waveform refers to a waveform of a signal transmitted by the modem. The modem also includes or is also communicatively coupled to an analog-to-digital converter (ADC) and a filter that are configured to perform dynamic filtering and decoding of signals and waveforms transmitted from the corresponding modems of one or more tools of the downhole communication system. In some embodiments, the filter is an anti-aliasing filter. In one or more of such embodiments, a differential amplifier with adjustable gain (or attenuation) is coupled to the ADC via the anti-aliasing filter. The ADC samples the waveform such that it can be analyzed and decoded by the modem processor. Additional descriptions of the modem and hardware components that are coupled to the modem are described herein and are provided in at least FIG. 2.

In some embodiments, the modem(s) of the downhole communication system are configured to operate in a spectrum analyzer mode, where the modem of the controller (controller modem) does not actively transmit signals to the modems of the tools, sensors, nodes, and other components of the downhole communication system (worker modems). Instead, the controller and/or worker modems listen for and samples interference and other non-desirable signals along a bus or subbus of the downhole communication system. In one or more of such embodiments, one or more of the controllers and/or worker modems, in response to a determination that the interference signal or the non-desirable signal is greater than a threshold amount (such as a threshold amplitude, or covers more than a threshold band or frequency span), determines a frequency band the interference signal resides within. In one or more of such embodiments, the one or more modems also instruct and/or control corresponding DACs and the amplifiers to adjust the frequency band, bandwidth, or frequency content of subsequent transmission waveforms to avoid transmitting within the band of the interference signal.

In some embodiments, the worker modems operate as part of a default mode of operation, during which the worker modems are configured to report signals indicative of an unexpected behavior or event (such as signals that are below a threshold level that do reach to controller, or noise bursts and/or glitches) that is sensed by a respective worker modem from a neighboring tool or the tool of the respective worker modem to the controller as part of cooperative bottomhole assembly health sensing and/or monitoring operation. In one or more of such embodiments, the controller then determines, based on diagnostics received from one or more tools, the location of an unhealthy segment of the bottomhole assembly, and determines whether to change a mode of communication or change a mode of operation to improve communication and/or reduce interference.

Figure 2:
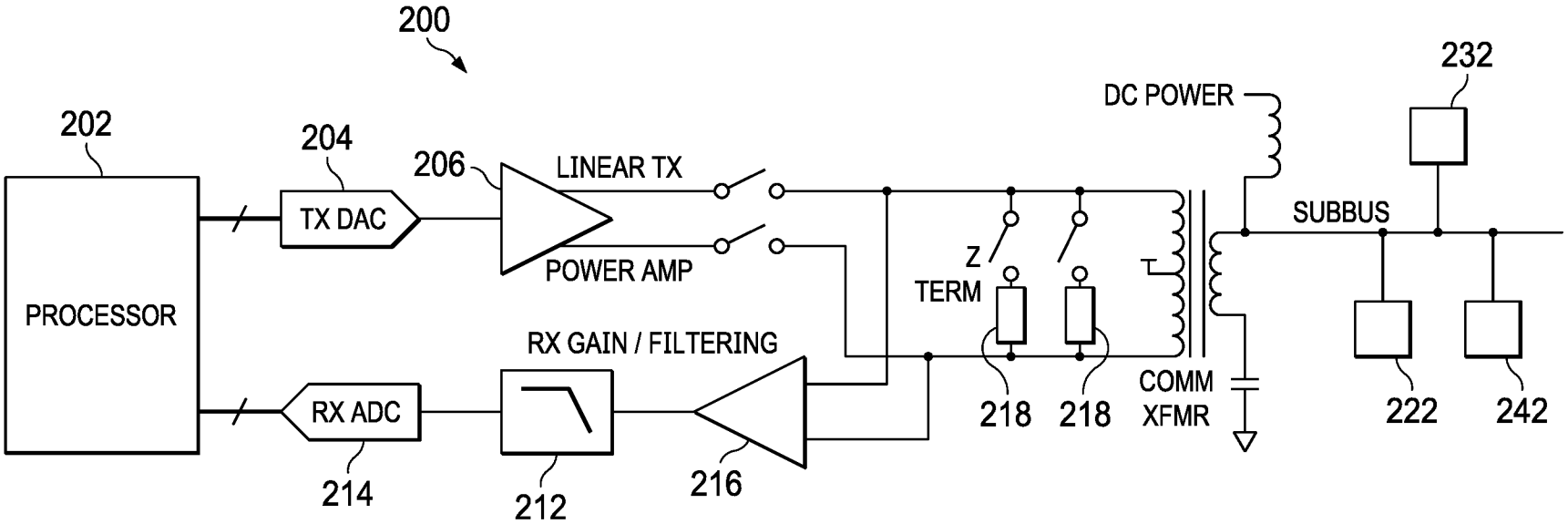
FIG. 2 is a schematic view of a modem of a controller of a downhole communication system of the drilling system of FIG. 1 communicatively connected to one or more tools of the downhole communication system positioned along a subbus.

In some embodiments, the hardware components illustrated in FIG. 2 are utilized to perform an active sweep of workers such as the tools, sensors, nodes, and other components of the downhole communication system. In one or more of such embodiments, the controller modem initiates a frequency sweep of a frequency range. In one or more of such embodiments, the controller modem transmits a low harmonic (below a threshold harmonic) sinewave to conduct the frequency sweep. The worker modems of the tools, sensors, nodes, and other components of the downhole communication system, in response to detecting signals indicative of a frequency sweep, transmit response waveforms to the controller modem. As referred to herein, a response waveform is a waveform of a signal transmitted by the tool (or worker) in response to receiving the transmission waveform. The response waveforms are dynamically filtered and in-situ analysis of the response waveforms are performed. As referred to herein, an in-situ analysis of a downhole communication system, such as a bottomhole assembly, is an analysis performed while the components of the downhole communication system are in their respective downhole locations. In some embodiments, an in-situ analysis of the downhole communication system is performed dynamically and in real-time during one or more well operations, such as drilling operations, wireline operations, and other well operations that utilize one or more components of the downhole communication system.

In one or more of such embodiments, and in response to performing the in-situ analysis of the response waveform from a tool of the communication system, the controller modem transmits additional instructions to the tool, such as to initiate a frequency sweep to determine whether the forward and return paths from the controller to the tool and from the tool to the controller exhibit similar or identical behaviors. In one or more of such embodiments, the controller modem analyzes the response waveforms to determine one or more properties of the tool, such as the signal amplitude/phase versus frequency response of the tool, the distortion of signals transmitted from the tool, the location of the tool with respect to the modem and other tools, presence of interference at the tool, presence of possible resonance/ringing frequencies in-band and other properties of the tool. In one or more of such embodiments, the amplitude and/or phase data of the response waveform from the tool determines modifications to certain properties of subsequent transmission waveforms to the tool to improve communication with the tool. Examples of modifications to the properties of subsequent transmission waveforms include, but are not limited to, changes to one or more of communication frequency ranges, communication protocols, transmission power level, transmission waveform/signaling, receiver filtering, as well as modifications to other properties of the transmission waveform to improve communication with the tool as well as other tools of the downhole communication system.

Subsequent transmission waveforms are generated by the DAC and the amplifier of the controller modem to modify their properties in accordance with the determined modifications to improve communication with the tool. For example, where the controller modem determines avoiding a frequency band of concern would improve communication with the tool, the transmission waveform is generated by the DAC and the amplifier and modified to avoid the frequency band of concern. Similarly, where the controller modem determines that modifying the shape of the transmission wave (e.g., from a square wave to a trapezoid-shaped wave) would improve communication with the tool, the transmission waveform is generated by the DAC and the amplifier to modify the shape of the transmission waveform into the desired shape, such as a trapezoid-shaped wave. In some embodiments, after the controller determines a change to implement, the controller modem communicates the determined change to the workers. In one or more of such embodiments, the workers implement the same change or corresponding changes based on the change implemented by the controller. In another one of such embodiments, the workers dynamically determine changes based on signals or instructions received from the controller.

In some embodiments, the controller modem also determines, based on the in-situ analysis, adjustments to the ADC and/or to the filter to fine-tune response waveforms to filter out noise, interference, and other undesirable signals, and to improve the signal-to-noise ratio of signals transmitted by the tool. In one or more of such embodiments, the modem processor of the controller modem also applies a digital signal processing noise filtering technique to filter out noise, extract tool response signals of the tool from noise, improve signal-to-noise ratio of signals transmitted by the tool, and improve communication with the tool. In some embodiments, the modem is communicatively coupled to a tunable multi-channel communications filter, or the filter is a tunable multi-channel communications filter. In one or more of such embodiments, the controller modem is configured to adjust the tunable multi-channel communications filter to be properly tuned for a multi-channel communications operating frequency to communicate with the tools, sensors, nodes, and other components of the downhole communication system to improve communication with the tools, sensors, nodes, and other components of the downhole communication system.

In some embodiments, the controller modem, in addition to or in lieu of tuning the transmitter and receiver components (e.g., DAC, ADC, filter, amplifiers, and other components) of the controller modem to modify and/or decode transmission or response waveforms, also requests the worker modems of the tools, sensors, nodes, and other components of the downhole communication system to perform one or more tuning operations to improve communication with the controller modem or to make one or more adjustments to improve the property of subsequent response waveforms. In one of more of such embodiments, the controller modem analyzes a response waveform from a worker tool of the downhole communication system for the presence of an interference, a resonance notch (where a notch is a resonance impedance condition on the bus), a noise, or another indication of an undesirable signal or condition that occurs within a second band, where the second frequency band is within the frequency band of the communication channel/response waveform. The controller modem then requests the tool to adjust the frequency band/frequency content of subsequent responses to avoid the second frequency band, such as by shifting the frequency band of subsequent response to a new band that is above the second band or below the band, or by refraining from transmitting any signals within the second band.

In one or more of such embodiments, the controller modem analyzes a response waveform from the tool of the downhole communication system for the presence of an interference (low signal to interference ratio), and requests the tool to adjust a communication protocol used by the tool to transmit response signals. In one or more of such embodiments, the controller modem, in response to a determination that the interference is greater than a threshold interference, requests the worker tool modem(s) to use/switch to one of a narrow-band communication protocol, such as (but not limited to) QPSK, FSK, QAM, or OFDM. In one or more of such embodiments, the controller modem, in response to a determination that the interference is not greater than the threshold interference, requests the worker tool modem to use/switch to one of a wideband communication protocol, such as (but not limited to) MIL-STD-1553, AMI or PAM. In one or more of such embodiments, the controller modem analyzes the signal amplitude versus frequency response of the waveforms transmitted by the workers. In some embodiments, the controller modem infers an impedance of the bus from the amplitude versus frequency response measured during a frequency sweep. In one or more of such embodiments, an impedance profile of the bus is generated based on the response waveform. In one or more of such embodiments, the impedance profile is analyzed to determine a frequency band below a threshold impedance (e.g., for which frequencies the bus impedance is too low). In one or more of such embodiments, the controller modem requests tools of the downhole communication system to make one or more adjustments described herein to improve communication and/or the impedance profile, such as by adjusting/switching the termination impedance used by the modem(s), or to improve the communications performance with the existing impedance profile, such as by avoiding those frequencies in the communication signals/waveforms and/or protocols at which the impedance is below the threshold impedance. In some embodiments, a diagnostic of the tool is performed based on the in-situ analysis of the response waveform, a current condition (e.g., health of the tool, temperature of the tool, vibrations experienced by the tool, and other conditions of the tool) of the tool and/or a change in the condition of the tool is determined, and an indication of the current condition and/or change in the condition of the tool is provided, such as to an electronic device.

In some embodiments, where the controller modem communicates with multiple worker modems of the tools, sensors, nodes, and other components of the downhole communication system, the operations described herein are performed to perform an in-situ analysis of each of the tools, sensors, nodes, and other components of the downhole communication system, to dynamically tune the transmitter and receiver components of the controller modem, and to dynamically request the tools, sensors, nodes, and other components of the downhole communication system to fine-tune their own modems to improve communication. In one or more of such embodiments, the controller modem also determines, based on the in-situ analysis of two or more tools, sensors, nodes, and other components of the downhole communication system, a frequency band the two or more tools communicate within, sensors, nodes, and other components of the downhole communication system. Similarly, in one or more of such embodiments, the controller modem also determines, based on the in-situ analysis of two or more tools, sensors, nodes, and other components of the downhole communication system, the existence of a resonance between the two or more tools, sensors, nodes, and other components of the downhole communication system. Although the foregoing paragraphs describe a controller-worker communication type architecture, in some embodiments, the architecture and methodologies described herein are utilized for semi peer-to-peer and full peer-to-peer communication types, where there are at least two controller nodes that initiate communications and where there is at least one worker, and where all nodes/tools are controllers and all initiate communications and talk when the bus is free, respectively. Further, although some operations are described from the perspective of the controller modem, in some embodiments, one or more workers include components of the controller modem and are configured to perform similar or identical operations described herein that are performed by the controller modem. In addition to downhole system health monitoring, the in-situ analysis results are used for tuning various parameters, that are initiated on transmitter or receiver side, to improve communication performance. Further, although the figures illustrate certain types of communication signals, the disclosed components and systems are configured to transmit and receive communication signals in multiple types of waveforms including, but not limited to, sinewaves, square waves, trapezoidal waves, and other types of waveforms. Additional descriptions of in-situ bottomhole assembly analysis systems and methods to perform an in-situ analysis of a downhole communication system are provided in the paragraphs below and are illustrated in at least FIGS. 1-10.

Referring to FIG. 1, a schematic view of a drilling system 100 is illustrated. The drilling system 100 includes a derrick 102 that is buttressed by a derrick floor 104. The derrick floor 104 supports a rotary table 106 that is driven during drilling at a desired rotational speed, for example, via a chain drive system through operation of a prime mover (not shown). The rotary table 106, in turn, provides the rotational force to a drill string 108 within a wellbore 109. The drill string 108, as illustrated, is coupled to a downhole communication system, such as a bottomhole assembly 110. In the embodiment of FIG. 1, the bottomhole assembly 110 includes sensors (not shown) configured to take survey measurements of a formation 112 and positioning measurements of a drill bit 114.

The drilling system 100 also includes a drilling fluid reservoir 116. The drilling fluid reservoir 116 provides drilling fluid (e.g., drilling mud) through the drill string 108 to the bottomhole assembly 110. The drilling fluid may continuously circulate through drill string 108, to an end 118 of the wellbore 109, and back to a surface 120. Further, the drilling fluid provides hydrostatic pressure that prevents formation fluids from entering into the wellbore 109, keeps the drill bit 114 cool and clean, and carries out drill cuttings during a drilling process. When a drilling motor is present within a steering system 124 between the bottomhole assembly 110 and the drill bit 114, the flow of drilling fluid through the drill string 108 generates power at the bottomhole assembly 110. In some embodiments, the power generated at the drilling motor provides power to the bottomhole assembly 110. While the drilling motor is described as a part of the steering system 124 positioned between the bottomhole assembly 110 and the drill bit 114, the drilling motor may be positioned anywhere along the drill string 108 sufficient to provide power to downhole tools of the drilling system 100.

In an embodiment, the steering system 124 is positioned in close proximity to the drill bit 114. The steering system 124 provides steering control to the drill bit 114 in addition to the drilling motor functions described above. For example, a target path 126 is programmed into the steering system 124 prior to commencing a drilling operation of the wellbore 109. The target path 126 may be embodied as instructions are stored in a memory of the steering system 124, and a processor of the steering system 124 executes the instructions to control the direction of drilling by the drill bit 114. Sensors within the bottomhole assembly 110 survey data to the steering system 124 during drilling operations that provide an indication of a location of the drill bit 114 during the drilling process. The steering system 124 uses this data to maintain the drill bit 114 on the target path 126 or to realign the drill bit 114 to the target path 126 when the steering system 124 receives an indication that the drill bit 114 has drifted from the target path 126.

Bottomhole assembly 110 includes or is communicatively coupled to a controller 184 and three workers (which represent tools of bottomhole assembly 110) 122, 132, and 142. Controller 184 and tools 122, 132, and 142 all contain a modem, which includes any electronic device or component of electronic device configured to perform the operations illustrated in FIG. 10. During a well operation, such as the drilling operation illustrated in FIG. 1, the modem of controller 184 periodically or continuously performs in-situ analysis of bottomhole assembly 110 and components of bottomhole assembly 110, such as tools 122, 132, and 142. In some embodiments, the modem of controller 184 periodically performs active and/or passive frequency sweep operations to communicate with the worker modems of tools 122, 132, and 142, and to determine one or more conditions of tools 122, 132, and 142. In some embodiments, the modem of controller 184 analyzes signals transmitted by the worker modems of tools 122, 132, and 142, and modifies transmission waveforms of transmission signals to improve communication with tools 122, 132, and 142. In some embodiments, the modem of controller 184 also fine-tunes response waveforms from tools 122, 132, and 142 to filter out noise and interference, and to improve the signal-to-noise ratio of signals transmitted by tools 122, 132, and 142. In one or more of such embodiments, the modem of controller 184 also applies a digital signal processing noise filtering technique to filter out noise, extract tool response signals of tools 122, 132, and 142 from noise, improve signal-to-noise ratio of signals transmitted by the worker modems of tools 122, 132, and 142, and improve communication with tools 122, 132, and 142.

In some embodiments, where the modem of controller 184 includes or is communicatively coupled to a tunable multi-channel communications filter, or the filter is a tunable multi-channel communications filter, the modem of controller 184 adjusts the tunable multi-channel communications filter to be properly tuned for a multi-channel communications operating frequency to communicate with tools 122, 132, and 142 to improve communication with tools 122, 132, and 142. In some embodiments, the modem of controller 184 also requests the worker modems of tools 122, 132, and 142 to make one or more adjustments including, but not limited to, adjustments to frequency band, communication protocol, and other adjustments described herein to improve communication. Additional descriptions of the modem of controller 184 and similar modems, and operations performed by the modem of controller 184 and similar modems are provided herein and are illustrated in at least FIGS. 2-10.

FIG. 1 illustrates a bottomhole assembly 110 having tools 122, 132, and 142 as an example of a downhole communication system. However, downhole communication systems described herein are not limited to bottomhole assemblies, and include any communication system for communicating with tools, sensors, nodes, and other components that are positioned downhole. Further, although FIG. 1 illustrates the modem of controller 184 in a downhole location, in some embodiments, the modem of controller 184 is positioned on the surface or implemented in the cloud. Further, although FIG. 1 illustrates three tools 122, 132, and 142, in some embodiments, bottomhole assembly 110 includes a different number of tools, sensors, nodes, and/or other components. Further, although FIG. 1 illustrates a drilling environment, in some embodiments the operations described herein are performed during other well operations, such as logging while drilling, measuring while drilling, and other types of well operations.

FIG. 2 is a schematic view of a controller modem 200 of controller 184 of the downhole communication system of the drilling system of FIG. 1 communicatively connected to and contained by one or more tools of the downhole communication system positioned along a subbus. In the embodiment of FIG. 2, the transmission side of controller modem 200 includes a DAC 204 coupled to an amplifier 206. DAC 204 and amplifier 206 are configured to generate and condition (control is by a processor 202 of controller modem 200) the waveform of transmission waveforms transmitted from controller modem 200, and to modify one or more properties of the transmission waveforms before the waveforms are transmitted to worker modems of tools 222, 232, and 242, as well as other tools and components of the downhole communication system. More particularly, a processor 202 of controller modem 200 controls DAC 204 and amplifier 206 to adjust the frequency band of transmission waveforms, modify the shape of transmission waveforms, modify the phase and timing of the transmission waveforms, and to make modifications described herein to improve communication with the worker modems of tools 222, 232, and 242. Although not illustrated, worker modems of tools 222, 232, and 242 have architectures that are similar or identical to controller modem 200, and are configured to perform similar or identical operations that are performed by controller modem 200 and described herein.

The receiving side of controller modem 200 includes an amplifier 216, a filter 212 configured to filter signals and waveforms transmitted from the worker modems of tools 222, 232, and 242, and an ADC 214 configured to decode signals and waveforms transmitted from controller and worker modems of tools 200, 222, 232, and 242. In some embodiments, amplifier 216 is a differential amplifier with adjustable gain (or attenuation). Processor 202 controls amplifier 216, filter 212, and ADC 214 to control and adjust the amplitude of response waveforms of signals transmitted from the worker modems of tools 222, 232, and 242, filter the response waveforms to remove or filter out noise, interference, and other undesirable signals, and to decode the signals. Processor 202 then performs operations described herein to conduct an in-situ analysis of the response waveforms of signals transmitted from the worker modems of tools 222, 232, and 242.

In some embodiments, processor 202, after performing an in-situ analysis of the response waveforms of signals transmitted from the worker modems of tools 222, 232, and 242, determines to modify one or more properties of subsequent transmission waveforms, such as by adjusting the frequency band, frequency content and/or bandwidth of subsequent transmission waveforms, by modifying the shape of subsequent transmission waveforms, and by making other types of modifications and/or adjustments to subsequent transmission waveforms to improve communication with tools 222, 232, and 242. In some embodiments, processor 202, after performing an in-situ analysis of the response waveforms of signals transmitted from the worker modems of tools 222, 232, and 242, also adjusts amplifier 216, filter 212, and/or ADC 214 to adjust the amplitude of subsequent response waveforms, filter out noise, interference, and other types of undesirable signals, and to modify the shape and other properties of the response waveforms to improve communication with tools 222, 232, and 242. In some embodiments, where filter 212 is a tunable multi-channel communications filter, processor 202 adjusts filter 212 to be properly tuned for a multi-channel communications operating frequency to communicate with tools 222, 232, and 242 to improve communication with tools 222, 232, and 242.

In some embodiments, processor 202 also requests worker modems of tools 222, 232, and 242 to make one or more adjustments (on the transmission and/or response side of tools 222, 232, and 242) to improve communication with controller modem 200 (e.g., the modem of controller 184 of FIG. 1). In one or more of such embodiments, processor 202 requests tools 222, 232, and 242 to perform operations described herein to adjust the transmission frequency of response waveforms to avoid transmitting in certain frequency ranges that contain noise, interference, and/or other undesirable signals. In one or more of such embodiments, processor 202 analyzes the amount of interference present in signals transmitted by the worker modems of tools 222, 232, and 242, and requests tools 222, 232, and 242 to adjust communication protocols to improve communication with controller modem 200. For example, processor 202, in response to a determination that the interference in signals transmitted from tool 222 is greater than a threshold interference, requests tool 222 to switch to (or maintain) one of a narrowband communication protocol such as (but not limited to) QPSK, FSK, QAM, or OFDM for subsequent transmissions. Moreover, processor 202, in response to a determination that the interference in signals transmitted from tools 232 and 242 is not greater than the threshold interference, requests tools 232 and 242 to switch to (or maintain) a wideband protocol such as Manchester, STD-1553, AMI, or PAM for subsequent transmissions. Similarly, processor 202 is also configured to maintain or switch to a different communication protocol to improve communication with tools 222, 232, and 242.

In some embodiments, processor 202 is also configured to perform the operations described herein to perform an in-situ analysis of communication between tools 222, 232, and 242. In one or more of such embodiments, processor 202 compares response waveforms transmitted by different tools 222, 232, and 242, and determines the frequency band among two or more of tools 222, 232, and 242. In another one of such embodiments, processor 202 compares response waveforms transmitted by different tools 222, 232, and 242 to determine locations of one or more resonances, interferences, and other undesirable signals between tools 222, 232, and 242. In one or more of such embodiments, processor 202 also requests tools 222, 232, and 242 to make one or more adjustments (on the transmission and/or response side of tools 222, 232, and 242) to improve communication with each other. In some embodiments, the foregoing operations performed by processor 202 are also performed by processors (not shown) of the worker modems of tools 222, 232, and 242 to receive instructions (such as from controller 184 of FIG. 1) to perform in-situ analysis, make certain adjustments (such as adjustments described herein) to improve or optimize communications, and/or report back the results to controller 184.

Although FIG. 2 illustrates controller modem 200 of controller 184 of FIG. 1, each tool also has a modem that is configured to transmit and receive signals and instructions. Further, although the foregoing paragraphs describe controller modem 200 as a modem of controller 184 of FIG. 1, in some embodiments, controller modem 200 is a modem of another controller. Further, although FIG. 2 illustrates three tools 222, 232, and 242, in some embodiments, the downhole communication system includes a different number of tools, sensors, nodes, and components that are configured to transmit signals to controller modem 200 and/or receive signals from controller modem 200 (via their own modems similar or identical to modem 200). Further, although FIG. 2 illustrates controller modem 200 communicating with three tools 222, 232, and 242 positioned along one subbus, in some embodiments, controller modem 200 communicates with tools 222, 232, 242, and other tools, sensors, nodes, and components that are positioned along multiple subbuses.

Figure 3:
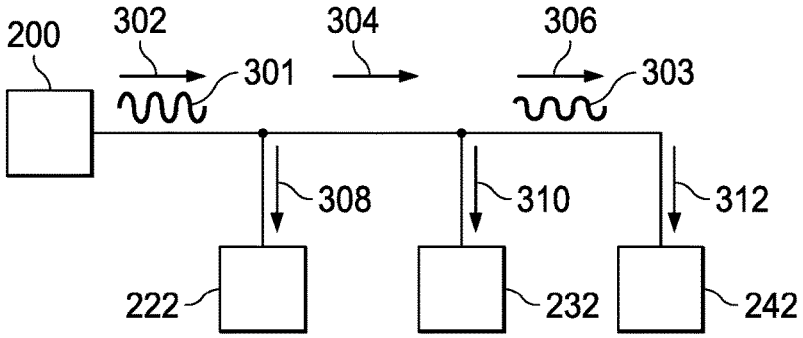
FIG. 3 is a schematic diagram of components of the downhole communication system of FIG. 2 during a frequency sweep operation.

FIG. 3 is a schematic diagram of components of the downhole communication system of FIG. 2 during a frequency sweep operation. In the embodiment of FIG. 3, controller modem 200 initiates a frequency sweep of a frequency range by actively transmitting transmission waveforms including waveforms 301 and 303 in directions illustrated by arrows 302, 304, 306, 308, 310, and 312 to tools 222, 232, and 242. Moreover, controller modem 200 transmits transmission waveforms of varying frequencies from one end of the frequency range to the other, where multiple waveforms may be transmitted and received at varying frequencies at known increments/spacings to create a complete frequency sweep. In some embodiments, tools 222, 232, and 242, in response to receiving transmission waveforms transmitted by controller modem 200, perform in-situ analysis on the received signals at the respective tools. In some embodiments, tools 222, 232, and 242, in response to receiving transmission waveforms transmitted by controller modem 200, transmit response waveforms to controller modem 200. Controller modem 200 performs operations described herein to filter the response waveforms and perform in-situ analysis of the response waveforms to determine the status and condition of tools 222, 232, and 242, noise, presence of interference, and other undesirable signals that hinder communication with the worker modems of tools 222, 232, and 242, and how to improve communication with tools 222, 232, and 242.

In some embodiments, controller modem 200 transmits additional instructions to tools 222, 232, and 242 to initiate a frequency sweep to determine whether the downlink and uplink paths from controller modem 200 to the worker modems of tools 222, 232, and 242 and from the worker modems of tools 222, 232, and 242 to the controller modem 200 exhibit similar or identical behaviors. In one or more of such embodiments, controller modem 200 analyzes the response waveforms to determine one or more properties of the worker modems of tools 222, 232, and 242, such as the communication frequency spectrum of tools 222, 232, and 242, the amplitude versus frequency response of signals transmitted from tools 222, 232, and 242, locations of tools 222, 232, and 242 with respect to controller modem 200, each other, and other tools, presence of interference at tools 222, 232, and 242, and other properties of tools 222, 232, and 242. In one or more of such embodiments, controller modem 200 generates an impedance profile of the impedance based on the response waveforms. In one or more of such embodiments, controller modem 200 analyzes the impedance profile of the response waveforms to determine a frequency band below a threshold impedance. In one or more of such embodiments, controller modem 200 requests tools 222, 232, and 242 to make one or more adjustments described herein to improve the impedance profile, such as by adjusting/switching the termination impedance used by the modem(s), or to improve the communications performance with the existing impedance profile, such as by avoiding those frequencies in the communication signals/waveforms and/or protocols at which the impedance is below the threshold impedance.

In some embodiments, controller modem 200, after performing an in-situ analysis of the response waveforms of the worker modems of tools 222, 232, and 242, performs one or more operations described herein to tune subsequent transmission waveforms and response waveforms transmitted from and received at controller modem 200, respectively, to improve communication with tools 222, 232, and 242. In some embodiments, controller modem 200, after performing in-situ analysis of the response waveforms of tools 222, 232, and 242, requests tools 222, 232, and 242 to make adjustments to their modems described herein to improve communication with controller modem 200 and with each other.

Figure 4:
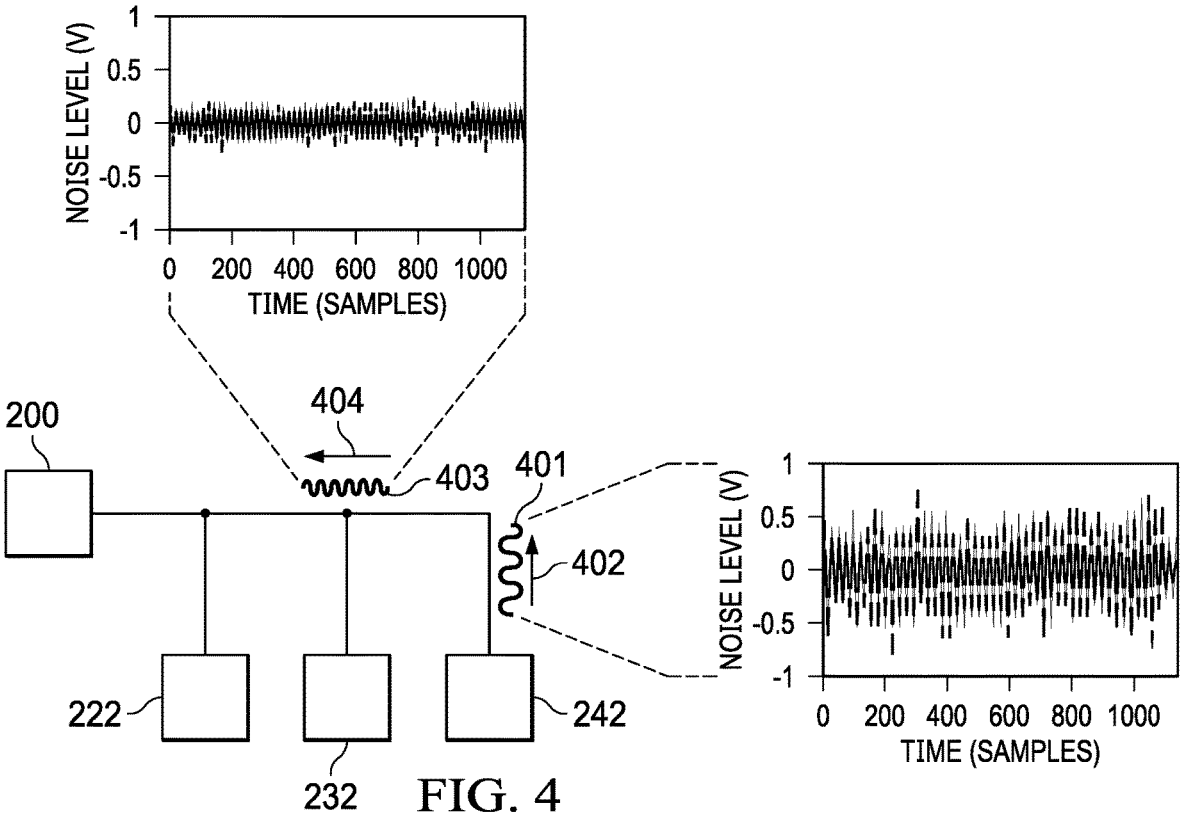
FIG. 4 is a schematic diagram of components of the downhole communication system of FIG. 2 during a passive frequency sweep operation.

FIG. 4 is a schematic diagram of components of the downhole communication system of FIG. 2 during a passive frequency sweep operation. In the embodiment of FIG. 4, controller modem 200 operates in a spectrum analyzer mode by passively listening to or scanning for signals that are injected and/or radiated onto the bus, such as by tools 222, 232, and 242. In the embodiment of FIG. 4 waveforms 401 and 403 in directions illustrated by arrows 402 an 404 represent noise generated by tool 242 as noise propagates along the bus. The reduction in the amplitudes of waveform 401 relative to waveform 403, and variations in the shapes of waveforms 401 and 403 represent loss of signal strength of the noise and signal distortion of the noise as the noise propagates along the bus, which acts as a lossy transmission line. Moreover, in some embodiments, as the noise continues to propagate along the bus, further signal attenuation causes waveforms of the noise to be undetectable by tool 222 or by controller 184 of FIG. 1. However, tool 232, in response to detecting waveform 403, notifies tool 222 and controller 184 regarding the presence of noise generated by tool 242. In one or more of such embodiments, data indicative of the presence of noise generated by tool 242 are directly transmitted from tool 242 to controller modem 200. In some embodiments, data indicative of the presence of noise generated by tool 242 are transmitted to one or more intermediary workers along the sub (such as tool 222) to notify all of the workers about the presence of noise generated by tool 242. In one or more of such embodiments, controller 200, in response to being notified about the presence of noise or interference along the bus, determines a frequency band within which the noise or interference exists, and communicates with all of the workers along the bus to avoid transmitting signals within the frequency band. In some embodiments, controller 184 and multiple tools such as tools 222, 232, and 242 concurrently operate in a spectrum analyzer mode by passively listening to and scanning for signals, such as noise or interference signals. In one or more of such embodiments, after noise or interference is detected by one of controller 184 and the tools, data indicative of the characteristics of the noise or interference is communicated to controller 184 and all of the tools along the sub. In some embodiments, controller modem 200 performs an in-situ analysis of signals transmitted by tools 222, 232, 242 to determine the status and condition of tools 222, 232, and 242, noise, presence of interference, and other undesirable signals that hinder communication with tools 222, 232, and 242, and how to improve communication with tools 222, 232, and 242. In some embodiments, controller modem 200, after performing the in-situ analysis of the waveforms obtained from tools 222, 232, 242 while controller modem 200 operated in the spectrum analyzer mode, performs one or more operations described herein to tune subsequent transmission waveforms and response waveforms transmitted from and received at controller modem 200, respectively, to improve communication with tools 222, 232, and 242. In some embodiments, controller modem 200, after performing in-situ analysis of the waveforms obtained from tools 222, 232, 242 while controller modem 200 operated in the spectrum analyzer mode, requests tools 222, 232, and 242 to make adjustments described herein to improve communication with controller modem 200 and with each other.

Figure 5A:
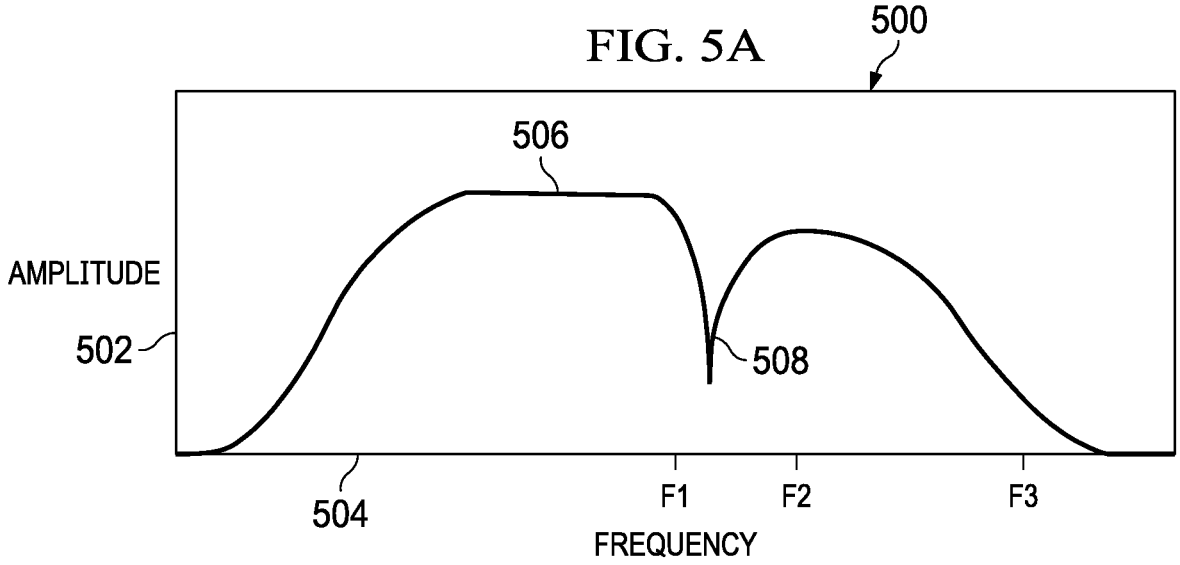
FIG. 5A is a graph illustrating a signal amplitude versus frequency response of a frequency sweep result having an in-band resonance notch.
Figure 5B:
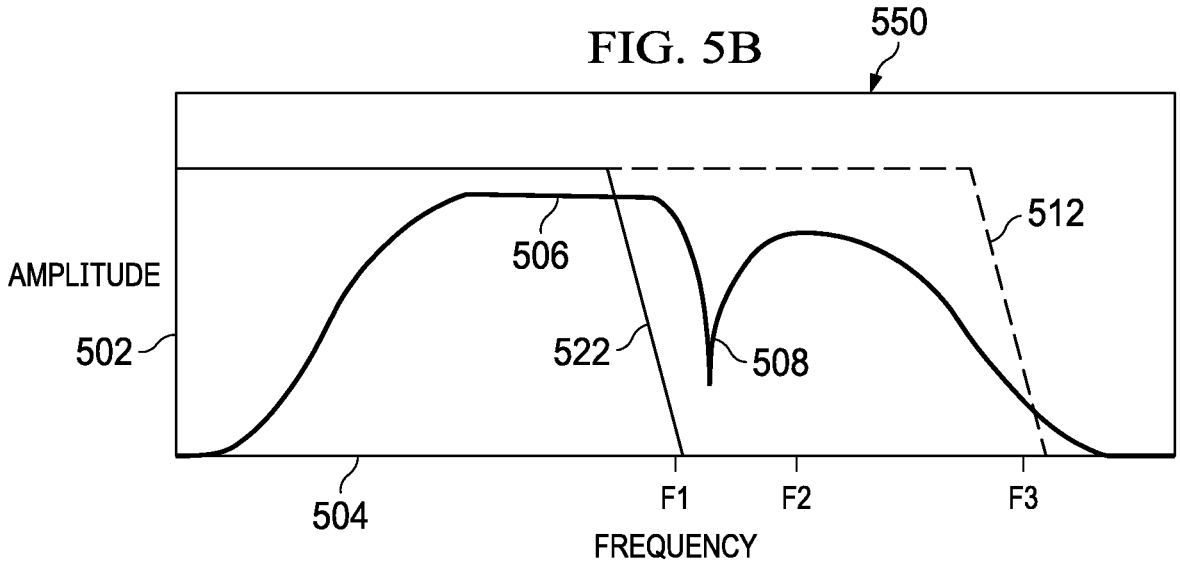
FIG. 5B is a graph illustrating a frequency cutoff adjustment made to a receiver filter to remove the resonance notch.

FIG. 5A is a graph 500 illustrating a signal amplitude versus frequency response 506 of a frequency sweep result having an in-band resonance notch 508. FIG. 5B is a graph 550 illustrating a frequency cutoff adjustment made to a receiver filter (such as filter 212 of FIG. 2) to remove the resonance notch from the frequency band. In the embodiment of FIGS. 5A and 5B, axis 502 represents the signal amplitude, and axis 504 represents the frequency. In the embodiment of FIGS. 5A and 5B, resonance notch 508 is present between approximately frequencies F1 and F2, where frequencies F1, F2, and F3 represent different frequencies within a frequency range. Further, dash line 512 of FIG. 5B represents an original upper bound of the frequency band at approximately F3, whereas line 522 represents an adjusted upper bound of the frequency band at approximately F1 that cuts off resonance notch 508. For example, controller modem 200 of FIG. 2, in response to performing an in-situ analysis of frequency sweep response 506, and upon determining that resonance notch 508 is present between F1 and F2, adjusts the receiver frequency band from having an upper bound of F3 to F1. In some embodiments, controller modem 200 also filters out signals above F1 or between F1 and F2 to remove the effects of resonance notch 508. In some embodiments, controller modem 200 applies a digital signal processing algorithm to filter out resonance notch 508. In some embodiments, controller modem 200 also instructs tools, such as tools 222, 232, and 242 of FIG. 2 to adjust the frequency band of future signals (such as by increasing the lower bound of the frequency band to above F2 or decreasing the upper bound of the frequency band to below F1) to avoid the frequency band containing resonance notch 508.

Figure 6A:
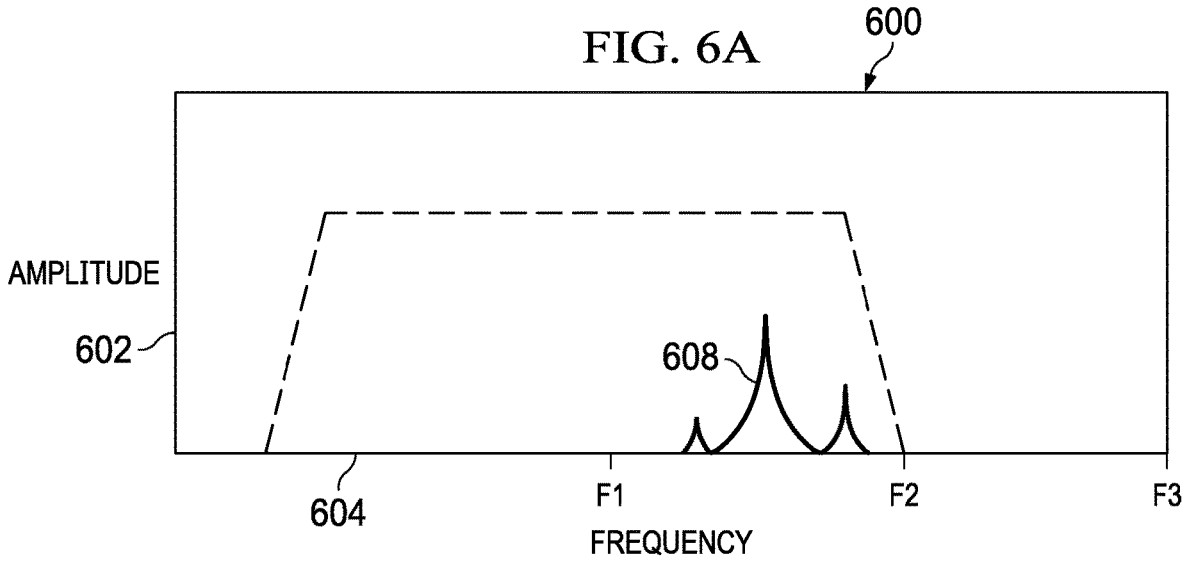
FIG. 6A is a graph illustrating an amplitude versus frequency response of an in-band interference signal.
Figure 6B:
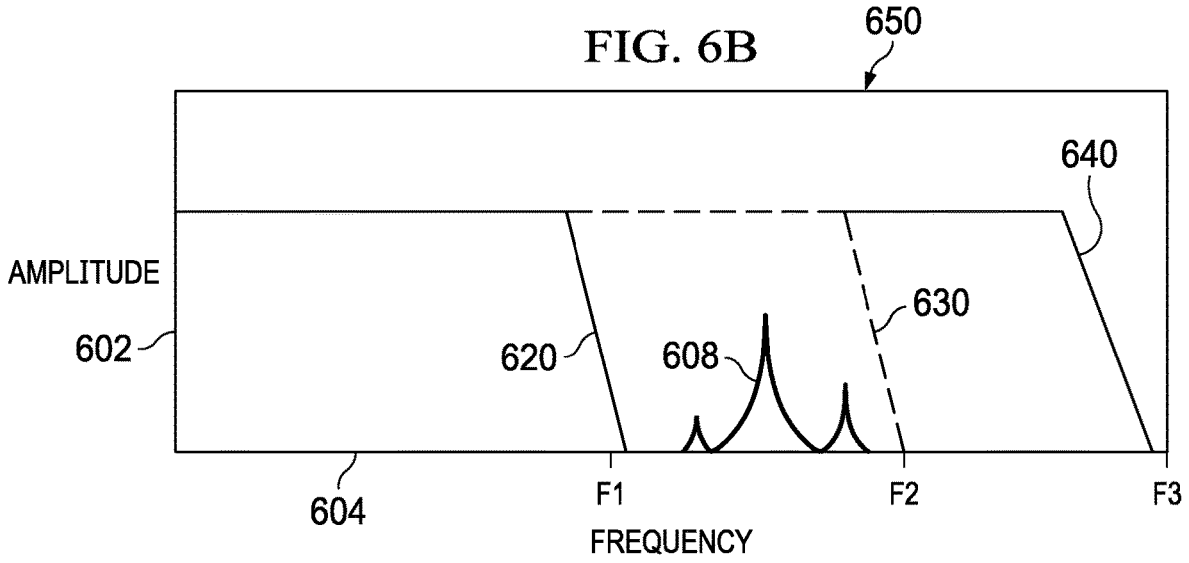
FIG. 6B is a graph illustrating a frequency cutoff adjustment made to a receiver filter to remove the interference signal.

FIG. 6A is a graph 600 illustrating an amplitude versus frequency response of an in-band interference signal 608. FIG. 6B is a graph 650 illustrating a frequency cutoff adjustment made to a receiver filter (such as receiver filter 212 of FIG. 2) to remove interference signal 608 from the frequency band. In the embodiment of FIGS. 6A and 6B, axis 602 represents signal amplitude, and axis 604 represents the frequency. In the embodiment of FIGS. 6A and 6B, interference signal 608 is present between approximately frequency F1 and frequency F2 (where frequencies F1, F2, and F3 represent different frequencies within a frequency range), and is greater than a threshold interference (e.g., having an amplitude that is above a threshold amplitude, or taking up more than a threshold frequency band). Further, dash line 630 of FIG. 6B represents an original upper bound of the frequency band at approximately F2, whereas line 620 represents an adjusted upper bound of the frequency band at approximately F1 that cuts off interference signal 608, and line 640 represents another adjusted upper bound of the frequency band at approximately F3. For example, controller modem 200 of FIG. 2, in response to performing an in-situ analysis, and upon determining that interference signal 608 is present between F1 and F2 and is greater than a threshold interference, adjusts the receiver frequency band from having an upper bound of F2 to F1. In some embodiments, controller modem 200 also filters out signals above F2 or between F1 and F2 to remove interference signal 608. In some embodiments, controller modem 200 applies a digital signal processing algorithm to filter out interference signal 608. In some embodiments, controller modem 200 adjusts the lower bound of the frequency band to F2 and the upper bound of the frequency band to F3 to avoid interference signal 608. In some embodiments, controller modem 200 also instructs tools, such as tools 222, 232, and 242 of FIG. 2 to adjust the frequency band of future signals (such as by increasing the lower bound of the frequency band to above F2 or decreasing the upper bound of the frequency band to below F1) to avoid the frequency band containing interference signal 608. Although FIG. 6B illustrates filtering out or removing interference signal 608, the operations described herein and illustrated in FIGS. 5B and 6B are also applicable to adjust signal frequency band to avoid or filter out noise and other types of undesirable signals.

Figure 7A:
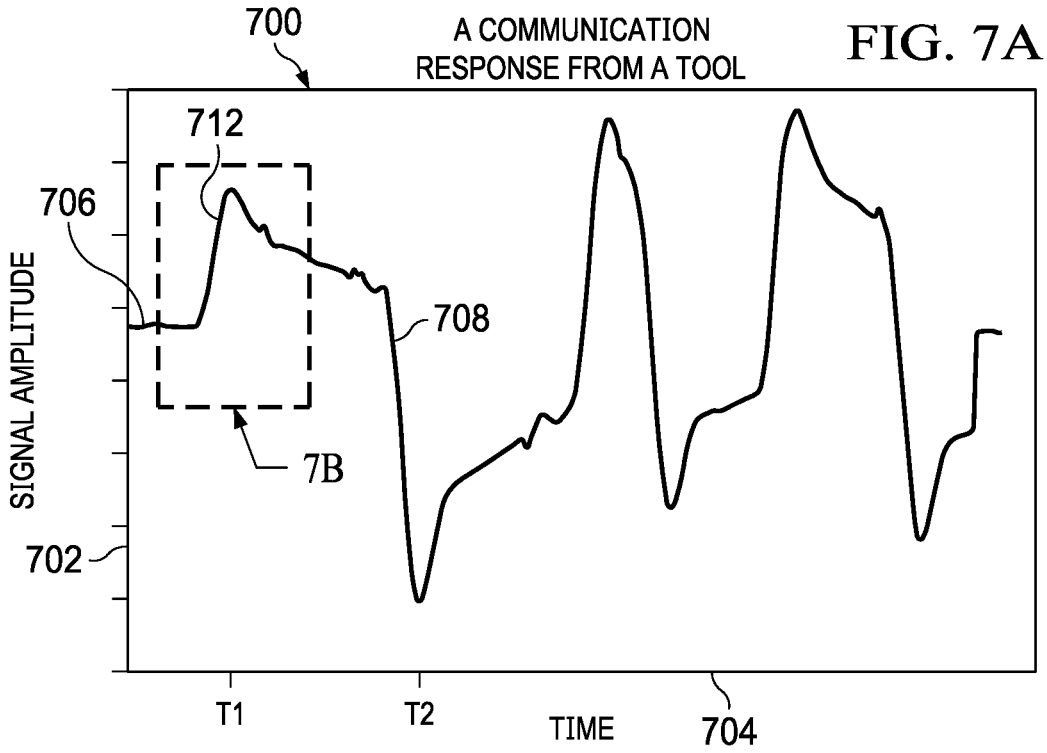
FIG. 7A is a graph illustrating a partial communications response signal that is transmitted by a modem of a tool of a downhole communication system.
Figure 7B:
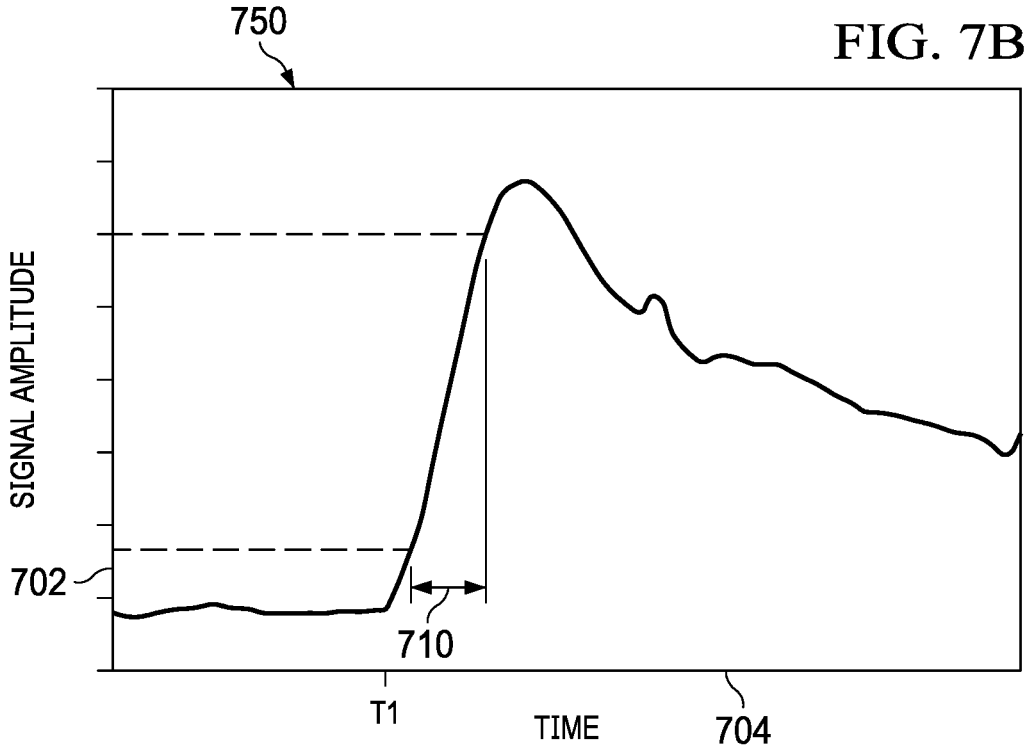
FIG. 7B is a zoomed-in view of a section of the graph of FIG. 7A and illustrating a rise time of the signal edge of FIG. 7A.

FIG. 7A is a graph 700 of a partial communications response signal 706 from a modem of a tool of a downhole communication system, such as tool 222 of the downhole communication system of FIG. 2. More particularly, FIG. 7A illustrates a signal rising edge 712 and a signal falling edge 708 of partial communications response signal 706. Further, FIG. 7B is a graph 750 of a zoomed-in view of a section of the graph of FIG. 7A and illustrating a rise time 710 of signal edge 712 of FIG. 7A. In the embodiment of FIGS. 7A and 7B, axis 702 represents signal level, and axis 704 represents time. In the embodiment of FIGS. 7A and 7B, signal rising edge 712 is detected at approximately time T1, and signal falling edge is detected at around time T2. In the embodiment of FIGS. 7A and 7B, the controller modem, such as controller modem 200 of FIG. 2 utilizes the rise or fall time(s) from the tool/worker response waveforms to estimate the bandwidth, where bandwidth is determined based on the following equation:

$$\text{Bandwidth} \approx \frac{0.35}{\text{Rise Time}} \qquad \text{Equation 1}$$

This bandwidth estimation is utilized to determine if higher/lower band rates (multispeed communications) should be used in downhole communications. In addition, the bandwidth estimation is utilized to determine the state of health of the downhole communication system, and/or tools and components of the downhole communication system. In addition, the bandwidth estimation is also utilized to determine the presence and locations of resonance notches and other undesirable bus conditions among the tools and components of the downhole communication system, such as the presence and location of a resonance notch between tools 222 and 232 of FIG. 2.

Figure 8:
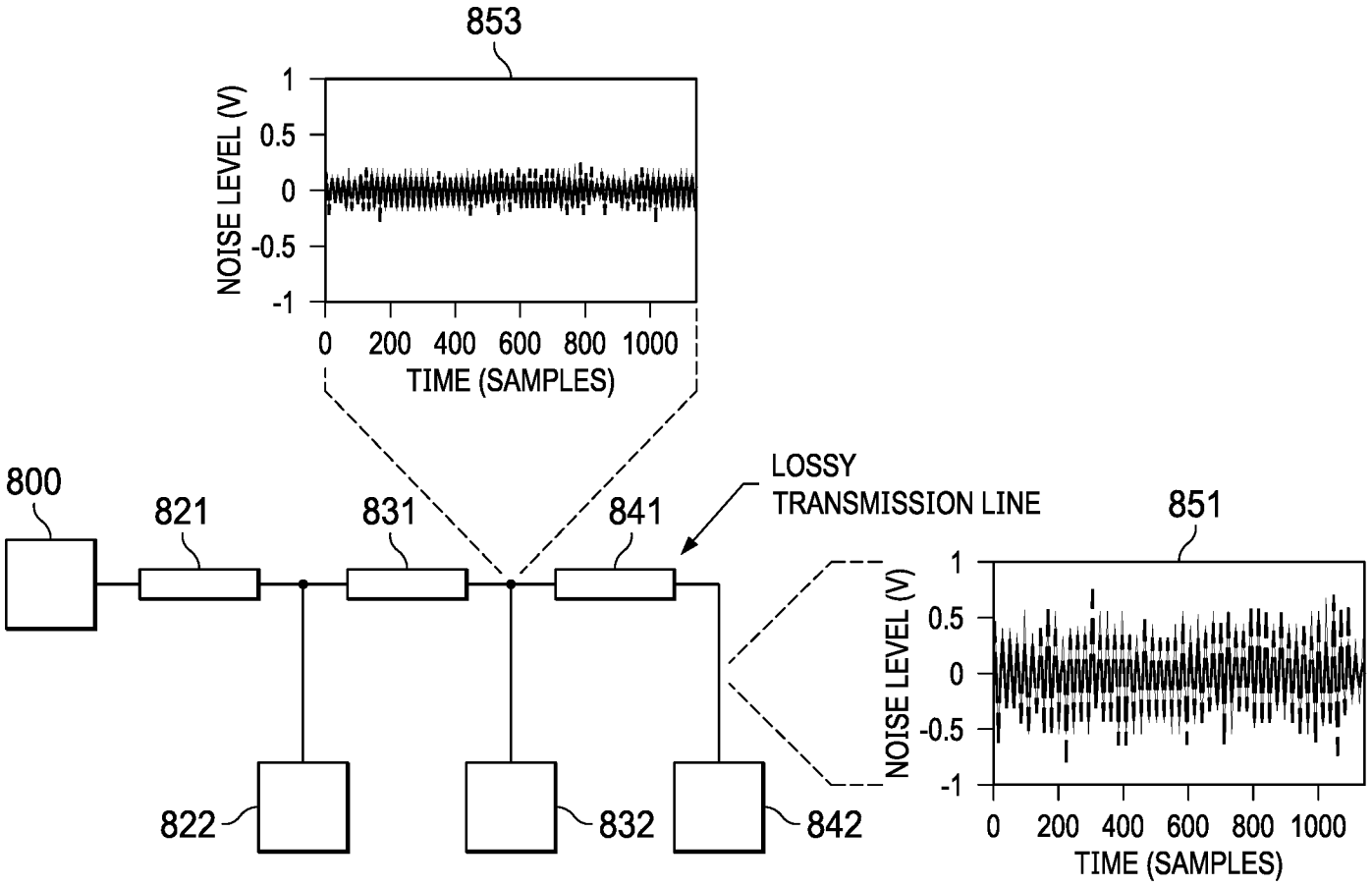
FIG. 8 is a system diagram illustrating the cooperative health monitoring in a downhole communication system where a modem in a tool captures unexpected noise burst generated by a neighboring tool and reports the unexpected noise burst to the controller.

FIG. 8 is a system diagram illustrating the cooperative health monitoring in a downhole communication system where a modem in a tool 832 captures unexpected noise burst generated by a neighboring tool 842 and reports it to a controller 800. In the embodiment of FIG. 8, controller 800 and tools 822, 832, and 842 are positioned along a bus. However, lossy transmission lines 821, 831, and 841 and impedance mismatch and loads from tools that connect controller 800 and tools 822, 832, and 842 contribute to signal attenuation of signals transmitted along the subbus. In the embodiment of FIG. 8, signal waveforms 851 and 853 of a noise burst generated by tool 842 are attenuated and distorted as waveforms 851 traverses transmission line 841. In some embodiments, further attenuation and distortion of signals traveling along transmission line 831 and 821 cause waveforms of noise generated by tool 842 to be undetectable by controller 800 and tool 822. However, tool 832, in response to detecting signal waveforms 851 of the noise generated by tool 842, transmits data indicative of characteristics of the noise (such as the frequency band of the noise, the amplitude of the noise, the determined cause of the noise, as well as other characteristics of the noise) to controller 800 and all of the tools along the bus to proactively monitor and maintain the health of the downhole communication system. In some embodiments, cooperative communications are established with controller 800 by the intermediary tools such as 832 or 822 upon receiving weak responses that do not reach a tool that is positioned further away from controller 800, such as tool 842, to controller 800. In one or more of such embodiments, one or more intermediary tools initiates cooperative communications operations in response to detecting weak signals (e.g., below a threshold signal threshold) and/or number of retries (e.g., more than a threshold number of retries).

Figure 9:
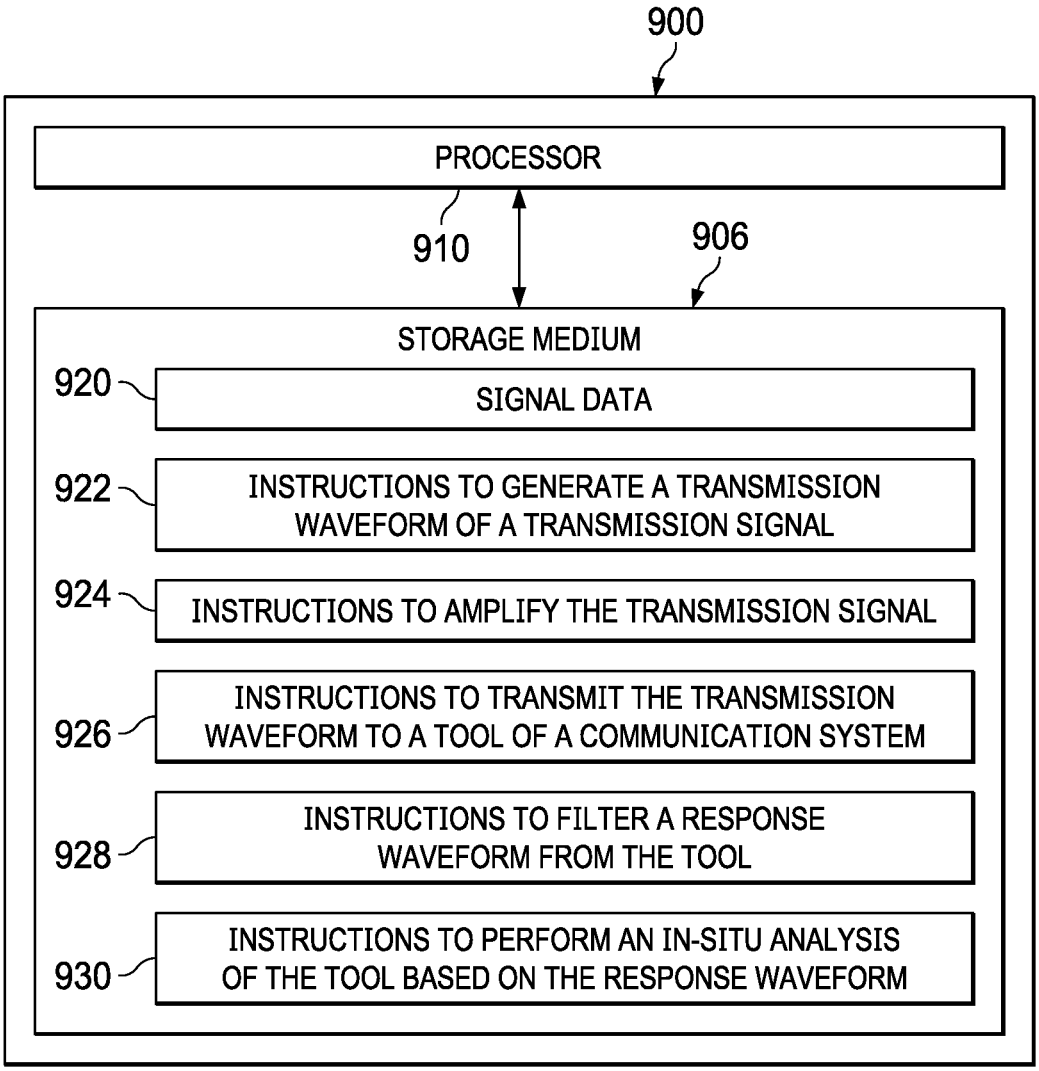
FIG. 9 is a system diagram of an in-situ downhole communications analysis system.

FIG. 9 is a system diagram of an in-situ downhole communications analysis system 900. System 900 includes a storage medium 906 and a processor 910. The storage medium 906 may be formed from data storage components such as, but not limited to, read-only memory (ROM), random access memory (RAM), flash memory, magnetic hard drives, solid state hard drives, CD-ROM drives, DVD drives, floppy disk drives, as well as other types of data storage components and devices. In some embodiments, the storage medium 906 includes multiple data storage devices. In further embodiments, the multiple data storage devices may be physically stored at different locations. In some embodiments, storage medium 906 is a component of controller modem 200 of FIG. 2. Data associated with signals transmitted and/or received by a modem, tools, sensors, nodes, and other components of a downhole communication system (collectively "signal data") are stored at a first location 920 of storage medium 906. Further, instructions to generate a transmission waveform of a transmission signal are stored at a second location 922 of storage medium 906. Further, instructions to amplify the transmission signal, where the transmission waveform is generated and modified by a DAC and an amplifier that are configured to modify a property of the transmission waveform are stored at a third location 924. Further, instructions to transmit the transmission waveform to a tool of a communication system are stored at a fourth location 924 of storage medium 926. Further, instructions to filter a response waveform from the tool, the response waveform being a waveform of a signal transmitted by the tool in response to receiving the transmission waveform are stored at a fifth location 928 of storage medium 906. Further, instructions to perform an in-situ analysis of the tool based on the response waveform are stored at a sixth location 930 of storage medium 906. Further, additional instructions that are performed by the processor 910 are stored in other locations of the storage medium 906. In some embodiments, processor 910 represents processor 202 of controller modem 200 of FIG. 2. In some embodiments, system 900 includes multiple modems 200 of FIG. 2 that are communicatively connected to each other to perform the operations described herein.

Figure 10:
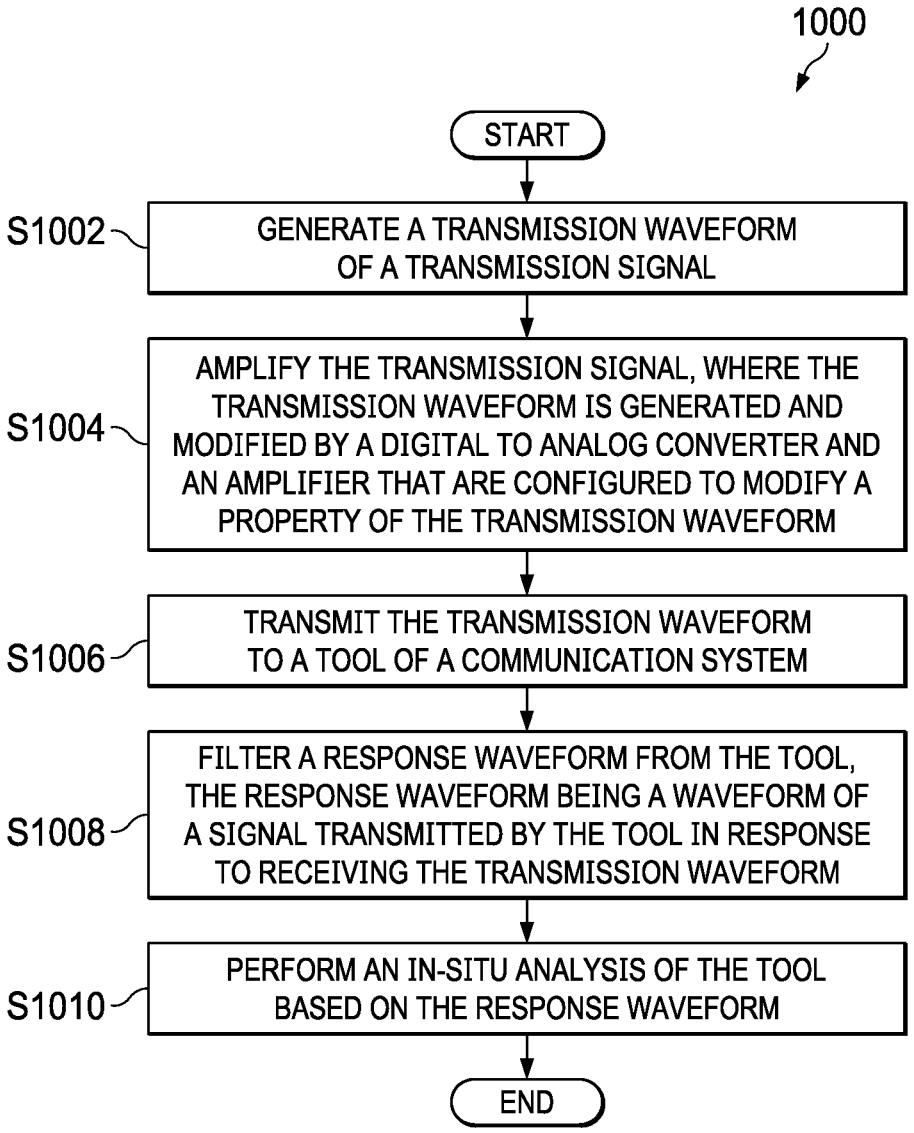
FIG. 10 is a flow chart of a method to perform an in-situ analysis of a downhole communication system.

FIG. 10 is a flow chart of a method to perform an in-situ analysis of a downhole communication system. Although the operations in process 1000 are shown in a particular sequence, certain operations may be performed in different sequences or at the same time where feasible. As described below, process 1000 provides an intuitive way for determining an activity associated with an object of interest.

At blocks S1002 and S1004, a transmission waveform of a transmission signal is generated and amplified by a DAC and an amplifier, respectively. In the embodiment of FIG. 2, processor 202 of controller modem 200 provides data/commands to generate and amplify the transmission waveforms to DAC 204 and amplifier 206, which are configured to modify the shape, frequency band, bandwidth, amplitude, and other properties of the transmission waveforms. In one or more of such embodiments, processor 202 sends data/commands to the DAC to generate a desired waveform, the amplifier then amplifies and conditions the signal and produces the power required to drive it on the bus, the DAC and the amplifier work together to generate the waveform that is transmitted onto the bus. At block S1006, and after generating the transmission waveform through the DAC and the amplifier, the transmission waveform is transmitted to a tool of a communication system. In the embodiment of FIG. 2, transmission waveforms are transmitted to tools 222, 232, and 242. At block S1008, a response waveform from the tool is filtered. In the embodiment of FIG. 2, response waveforms are filtered by filter 212. Further, the response waveforms are decoded by ADC 214. At block S1010, an in-situ analysis of the tool is performed based on the response waveform. In the embodiment of FIG. 2, processor 202 of controller modem 200 performs operations described herein to perform in-situ analysis of tools 222, 232, and 242 based on signals transmitted by tools 222, 232, and 242, respectively. In some embodiments, a modification to a property of subsequent transmission waveforms is determined based on the in-situ analysis to improve subsequent communication with the tool. In one or more of such embodiments, the determined modification is made to the subsequent transmission waveforms before the transmission waveforms are transmitted to the tool.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence or combined into a single step/process. The scope of the claims is intended to broadly cover the disclosed embodiments and any such modification. Further, the following clauses represent additional embodiments of the disclosure and should be considered within the scope of the disclosure.

Clause 1, a method to perform an in-situ analysis of a downhole communication system, the method comprising: generating a transmission waveform of a transmission signal; amplifying the transmission signal, wherein the transmission waveform is generated and modified by a digital to analog converter and an amplifier that are configured to modify a property of the transmission waveform; after generating the transmission waveform through the digital to analog converter and the amplifier, transmitting the transmission waveform to a tool of a communication system; filtering a response waveform from the tool, the response waveform being a waveform of a signal transmitted by the tool in response to receiving the transmission waveform; and performing an in-situ analysis of the tool based on the response waveform.

Clause 2, the method of clause 1, further comprising: determining, based on the in-situ analysis, a modification to a property of a second transmission waveform to improve communication with the tool; and generating the second transmission waveform, wherein the second transmission waveform is generated and modified by the digital to analog converter and the amplifier.

Clause 3, the method of clause 2, wherein the property of the second transmission waveform is a frequency band of the second transmission waveform, and the method further comprising tuning the frequency band of the second transmission waveform to avoid a frequency band region within the frequency band of the second transmission waveform.

Clause 4, the method of clauses 2 or 3, wherein the property of the second transmission waveform is a shape of the second transmission waveform, and the method further comprising modifying the shape of the second transmission waveform.

Clause 5, the method of any of clauses 2-4, wherein the property of the second transmission waveform is an amplitude of the second transmission waveform, and the method further comprising adjusting the amplitude of the second transmission waveform.

Clause 6, the method of any of clauses 1-5, wherein performing the in-situ analysis comprises analyzing a property of the response waveform, and the method further comprising requesting the tool to make an adjustment to improve the property of a subsequent response waveform.

Clause 7, the method of clause 6, wherein the property of the response waveform is a frequency band of the response waveform, the method further comprising: analyzing the response waveform for a presence of an interference within the frequency band of the response waveform; determining a second frequency band within the frequency band of the response waveform that contains the interference; and requesting the tool to adjust a subsequent frequency band of the subsequent response waveform to avoid the second frequency band.

Clause 8, the method of clauses 6 or 7, wherein the property of the response waveform is a communication protocol of the response waveform, the method further comprising: requesting the tool to adjust the communication protocol used to transmit the subsequent response waveform.

Clause 9, the method of clause 8, wherein requesting the tool to adjust the communication protocol comprises: in response to a determination that the interference is greater than a threshold interference, requesting the tool to use one of a first set of communication protocols comprising QPSK, FSK, QAM, and OFDM to transmit the subsequent response waveform; and in response to a determination that the interference is not greater than the threshold interference, requesting the tool to use a second set of communication protocols comprising Manchester, STD-1553, AMI, and PAM to transmit the subsequent response waveform.

Clause 10, the method of any of clauses 6-9, further comprising: analyzing a frequency spectrum of the response waveform for a presence of a resonance condition; determining a second frequency band within the frequency band of the response waveform that contains the resonance condition; and requesting the tool to adjust a subsequent frequency band of the subsequent response waveform to avoid the second frequency band.

Clause 11, the method of any of clauses 6-10, further comprising: generating, based on the response waveform, an impedance profile of an impedance of a bus the tool communicates on; analyzing the impedance profile for a frequency band below a threshold impedance; and requesting the tool to make the adjustment to improve communication or the impedance profile.

Clause 12, the method of any of clauses 1-11, further comprising: detecting presence of an interference signal that is greater than a threshold interference; in response to detecting the interference signal, determining a frequency band of the interference signal; and utilizing at least one of the analog to digital converter and the amplifier to adjust a frequency band of the transmission waveform to avoid the frequency band of the interference signal.

Clause 13, the method of any of clauses 1-12, wherein filtering the response waveform comprises filtering the response waveform to improve a signal-to-noise ratio of the response waveform.

Clause 14, the method of any of clauses 1-13, further comprising: performing a diagnostic of the tool based on the in-situ analysis of the response waveform; determining, a change to a condition of the tool based on the diagnostic; and providing an indication of the change to the condition of the tool.

Clause 15, the method of any of clauses 1-14, wherein after generating the transmission, the method further comprising: transmitting the transmission waveform to a second tool of the communication system; filtering a second response waveform from the second tool, the second response waveform being a second waveform of a second signal transmitted by the second tool in response to receiving the transmission waveform; and performing a second in-situ analysis of the second tool based on the second response waveform.

Clause 16, the method of clause 15, further comprising determining, based on the first in-situ analysis and the second in-situ analysis, a frequency band the first tool and the second tool communicate within.

Clause 17, the method of clauses 15 or 16, further comprising determining, based on the first in-situ analysis and the second in-situ analysis, a location of a source of resonance between the first tool and the second tool.

Clause 18, an in-situ bottomhole assembly analysis system, comprising: a storage medium; and one or more processors configured to: generate a transmission waveform of a transmission signal; amplify the transmission signal, wherein the transmission waveform is generated and modified by a digital to analog converter and an amplifier that are configured to modify a property of the transmission waveform; after the transmission waveform is generated, transmit the transmission waveform to a tool of a communication system; filter a response waveform from the tool, the response waveform being a waveform of a signal transmitted by the tool in response to receiving the transmission waveform; and perform an in-situ analysis of the tool based on the response waveform.

Clause 19, the in-situ bottomhole assembly analysis system of clause 18, wherein the one or more processors are further configured to: prior to generating the transmission waveform through the digital to analog converter, detect presence of an interference signal that is greater than a threshold interference; in response to detecting the interference signal that is greater than the threshold interference, determine a frequency band of the interference signal that is greater than the threshold interference; and utilize at least one of the digital to analog converter and the amplifier to adjust a frequency band of the transmission waveform to avoid the frequency band of the interference signal.

Clause 20, a non-transitory computer-readable medium comprising instructions, which when executed by one or more processors, cause the processors to perform operations comprising: generating a transmission waveform of a transmission signal; amplifying the transmission signal, wherein the transmission waveform is generated and modified by a digital to analog converter and an amplifier that are configured to modify a property of the transmission waveform; after generating the transmission waveform, transmitting the transmission waveform to a tool of a communication system; filtering a response waveform from the tool, the response waveform being a waveform of a signal transmitted by the tool in response to receiving the transmission waveform; and performing an in-situ analysis of the tool based on the response waveform.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A non-transitory computer-readable medium comprising instructions, which when executed by one or more processors, cause the processors to perform operations comprising:

generating a transmission waveform of a transmission signal;

amplifying the transmission signal, wherein the transmission waveform is generated and modified by a digital to analog converter and an amplifier that are configured to modify a property of the transmission waveform;

after generating the transmission waveform, transmitting the transmission waveform to a tool of a communication system;

filtering a response waveform from the tool, the response waveform being a waveform of a signal transmitted by the tool in response to receiving the transmission waveform;

performing an in-situ analysis of the tool based on the response waveform;

determining, based on the in-situ analysis, a modification to one or more properties of a second waveform, the one or more properties including a frequency band of the second waveform, wherein the modification to the one or more second waveform properties avoids a frequency band region within the frequency band of the second waveform by tuning the frequency band of the second transmission waveform to avoid the frequency band region within the frequency band of the second transmission waveform; and generating the second transmission waveform.

2. A method to perform an in-situ analysis of a downhole communication system, the method comprising:

generating a transmission waveform of a transmission signal;

amplifying the transmission signal, wherein the transmission waveform is generated and modified by a digital to analog converter and an amplifier that are configured to modify a property of the transmission waveform;

after generating the transmission waveform through the digital to analog converter and the amplifier, transmitting the transmission waveform to a tool of a communication system;

filtering a response waveform from the tool, the response waveform being a waveform of a signal transmitted by the tool in response to receiving the transmission waveform;

performing an in-situ analysis of the tool based on the response waveform;

determining, based on the in-situ analysis, a modification to one or more properties of a second waveform, the one or more properties including a frequency band of the second, wherein the modification to the one or more second waveform properties avoids a frequency band region within the frequency band of the second waveform by tuning the frequency band of the second transmission waveform to avoid the frequency band region within the frequency band of the second transmission waveform; and generating the second transmission waveform.

3. The method of claim 2, wherein the second transmission waveform is generated and modified by the digital to analog converter and the amplifier.

4. The method of claim 2, wherein the one or more properties of the second transmission waveform includes a shape of the second transmission waveform, and the method further comprises modifying the shape of the second transmission waveform.

5. The method of claim 2, wherein one or more properties of the second transmission waveform includes an amplitude of the second transmission waveform, and the method further comprises adjusting the amplitude of the second transmission waveform.

6. The method of claim 2, wherein performing the in-situ analysis comprises analyzing a property of the response waveform, and the method further comprises requesting the tool to make an adjustment to improve the property of a subsequent response waveform.

7. The method of claim 6, wherein the property of the response waveform is a frequency band of the response waveform, the method further comprising:

analyzing the response waveform for a presence of an interference within the frequency band of the response waveform;

determining a second frequency band within the frequency band of the response waveform that contains the interference; and requesting the tool to adjust a subsequent frequency band of the subsequent response waveform to avoid the second frequency band.

8. The method of claim 6, wherein the property of the response waveform is a communication protocol of the response waveform, the method further comprising:

requesting the tool to adjust the communication protocol used to transmit the subsequent response waveform.

9. The method of claim 8, wherein requesting the tool to adjust the communication protocol comprises:

in response to a determination that the interference is greater than a threshold interference, requesting the tool to use one of a first set of communication protocols comprising QPSK, FSK, QAM, and OFDM to transmit the subsequent response waveform; and in response to a determination that the interference is not greater than the threshold interference, requesting the tool to use a second set of communication protocols comprising Manchester, STD-1553, AMI, and PAM to transmit the subsequent response waveform.

10. The method of claim 6, further comprising:

analyzing a frequency spectrum of the response waveform for a presence of a resonance condition;

determining a second frequency band within the frequency band of the response waveform that contains the resonance condition; and requesting the tool to adjust a subsequent frequency band of the subsequent response waveform to avoid the second frequency band.

11. The method of claim 6, further comprising:

generating, based on the response waveform, an impedance profile of an impedance of a bus the tool communicates on;

analyzing the impedance profile for a frequency band below a threshold impedance; and requesting the tool to make the adjustment to improve communication or the impedance profile.

12. The method of claim 2, further comprising:

detecting presence of an interference signal that is greater than a threshold interference;

in response to detecting the interference signal, determining a frequency band of the interference signal; and utilizing at least one of the analog to digital converter and the amplifier to adjust a frequency band of the transmission waveform to avoid the frequency band of the interference signal.

13. The method of claim 2, wherein filtering the response waveform comprises filtering the response waveform to improve a signal-to-noise ratio of the response waveform.

14. The method of claim 2, further comprising:

performing a diagnostic of the tool based on the in-situ analysis of the response waveform;

determining, a change to a condition of the tool based on the diagnostic; and providing an indication of the change to the condition of the tool.

15. The method of claim 2, wherein after generating the transmission, the method further comprising:

transmitting the transmission waveform to a second tool of the communication system;

filtering a second response waveform from the second tool, the second response waveform being a second waveform of a second signal transmitted by the second tool in response to receiving the transmission waveform; and performing a second in-situ analysis of the second tool based on the second response waveform.

16. The method of claim 15, further comprising determining, based on the first in-situ analysis and the second in-situ analysis, a frequency band the first tool and the second tool communicate within.

17. The method of claim 15, further comprising determining, based on the first in-situ analysis and the second in-situ analysis, a location of a source of resonance between the first tool and the second tool.

18. An in-situ bottomhole assembly analysis system, comprising:

a storage medium; and one or more processors configured to:

generate a transmission waveform of a transmission signal;

amplify the transmission signal, wherein the transmission waveform is generated and modified by a digital to analog converter and an amplifier that are configured to modify a property of the transmission waveform;

after the transmission waveform is generated, transmit the transmission waveform to a tool of a communication system;

filter a response waveform from the tool, the response waveform being a waveform of a signal transmitted by the tool in response to receiving the transmission waveform;

perform an in-situ analysis of the tool based on the response waveform;

determine, based on the in-situ analysis, a modification to one or more properties of a second waveform, the one or more properties including a frequency band of the second waveform, wherein the modification to the one or more second waveform properties avoids a frequency band region within the frequency band of the second waveform by tuning the frequency band of the second transmission waveform to avoid the frequency band region within the frequency band of the second transmission waveform; and generate the second transmission waveform.

19. The in-situ bottomhole assembly analysis system of claim 18, wherein the one or more processors are further configured to:

prior to generating the transmission waveform through the digital to analog converter, detect presence of an interference signal that is greater than a threshold interference;

in response to detecting the interference signal that is greater than the threshold interference, determine a frequency band of the interference signal that is greater than the threshold interference; and utilize at least one of the digital to analog converter and the amplifier to adjust a frequency band of the transmission waveform to avoid the frequency band of the interference signal.

* * * * *